US005582100A

United States Patent [19]

Pinnow

[11] Patent Number: 5,582,100

[45] Date of Patent: Dec. 10, 1996

[54] DRAINAGE APPARATUS FOR PRESSES FOR SEPARATING LIQUIDS FROM SOLIDS

[75] Inventor: Dieter Pinnow, Unterehrendingen, Switzerland

[73] Assignee: Bucher-Guyer AG, Maschinenfabrik, Niederweningen/Zurich, Switzerland

[21] Appl. No.: 505,256

[22] PCT Filed: Nov. 25, 1994

[86] PCT No.: PCT/CH94/00225

§ 371 Date: Nov. 30, 1995

§ 102(e) Date: Nov. 30, 1995

[87] PCT Pub. No.: WO95/17299

PCT Pub. Date: Jun. 29, 1995

[30] Foreign Application Priority Data

Dec. 23, 1993 [CH] Switzerland ..... 03850/93

[51] Int. Cl.[6] ..... B30B 9/26

[52] U.S. Cl. ..... 100/107; 100/125

[58] Field of Search ..... 100/107–109, 100/116, 125

[56] References Cited

U.S. PATENT DOCUMENTS

| | | | |
|---|---|---|---|
| 3,207,064 | 9/1965 | Hauser-Bucher | 100/107 |
| 3,951,058 | 4/1976 | Hauser | 100/107 |
| 4,475,451 | 10/1984 | Hartmann | 100/107 |
| 5,054,952 | 10/1991 | Chara | 403/326 |
| 5,130,022 | 7/1992 | Chara | 100/107 |
| 5,361,691 | 11/1994 | Hartmann | 100/107 |

FOREIGN PATENT DOCUMENTS

| | | | |
|---|---|---|---|
| 0356914 | 3/1990 | European Pat. Off. | 100/116 |
| 413599 | 12/1966 | Switzerland | 100/107 |

*Primary Examiner*—Stephen F. Gerrity
*Attorney, Agent, or Firm*—Burns, Doane, Swecker, & Mathis, LLP

[57] ABSTRACT

Apparatus is provided to reduce filter abrasion in fruit juice presses of the type where juice is removed through a boundary wall (1) from a compression chamber by way of channels in each of a plurality of drainage cores (4) covered by filter envelopes (29). Each filter envelope (29) is attached to its drainage core (4) outside the region (35) in which the drainage core (25) is mounted on the boundary wall (1) of the press. Also, the drainage core includes a bending zone formed so that only slight bending stresses occur. Consequently the service life of the apparatus is distinctly increased with respect to the known systems.

14 Claims, 5 Drawing Sheets

DRAINAGE APPARATUS FOR PRESSES FOR SEPARATING LIQUIDS FROM SOLIDS

FIELD OF THE INVENTION

The present invention relates to drainage apparatus for presses which remove fluids from solid materials. It is concerned in particular with fruit presses of the type in which flow paths for conducting fluid out of the pressing chamber are provided by rod shaped flexible drainage cores surrounded by fluid-permeable filter envelopes. In these presses, at least one end of each drainage core is fastened to a part of the press which bounds the pressing chamber, such as to a juice collecting plate, to a pressing plate, or to the pressing jacket of the press.

BACKGROUND

A known fastening system such a drainage system in a fruit press is shown in longitudinal section in FIG. 1. This system includes a multitude of drainage assemblies 3 disposed in a pressing chamber 2 one boundary of which is defined by a pressing plate 1. Only one of these assemblies is shown. It includes an elastic drainage core 4, via whose external grooves 5 (shown in FIG. 1A) the fluid is conducted out of the pressing chamber 2 during the pressing process, and a sock-shaped filter 6 for solid-fluid separation. The filter 6 is stretched over the core 2. The ends of the drainage core and the filter 6 are fastened in a core retainer 7. The filter 6 is guided via an elastic sleeve 8 and fixed with an O-ring 9. A disk 10 serves to support the sleeve 8 against a lateral pin 11, which is thrust crosswise into bores of the drainage core 4 and the core retainer 7, fixing the elements 4 and 7 to each other both axially and radially.

The core retainer 7 is connected to the pressing plate 1 with the aid of a distance bush 12 and a snap ring 13. A cam 14 of the snap ring 13, which engages in a groove 16 of the core retainer 7 by means of a slit 15 in the distance bush 12, cooperates with a collar 17 on the distance bush behind the plate 1 to secure the parts against axial sliding.

As shown in FIG. 1, during the pressing process, the drainage core 4 is bent sharply upstream of where it is clamped in the pressing plate 1. The disadvantage this known type of filter—and drainage core fastening is primarily that due to mechanical stress, the filter is damaged in the abrasion zones 18 and 19. This occurs in abrasion zone 18 by clamping the filter 6 between the drainage core 4 and the sleeve 8 and in abrasion zone 19 by filter abrasion as a result of pulling the filter 6 over the sleeve 8.

The sharp bending of the drainage core 4 also shortens its service life and partly hinders the discharge of fluid through the grooves 5 of the drainage core 4. The problem is the bending of the grooves 5, which are disposed on the circumference of the drainage core 4, due to compressive stresses which occur and which are symbolized in FIG. 1 by the character $\sigma$. The cross section reduction of the grooves 5 resulting from this hinders the discharge of fluid and increases the danger of stoppage by means of deposited solid matter.

SUMMARY OF THE INVENTION

An object of the invention is to prevent the disadvantages mentioned, primarily the high filter abrasion.

According to the invention, the location where the permeable filter envelope is fastened to the drainage core is spaced apart from the location where the core is fastened to the adjacent compression chamber boundary member, and a connecting portion of the drainage core between these locations has a diminished rigidity so that flexing of the unit occurs only in this region.

It proves to be particularly advantageous if in the bending region of the drainage element, the fluid discharge does not take place by means of external conduits on the drainage core, but by means of one central conduit or a plurality of them. In this manner, it is possible to prevent the cross sectional reductions at the grooves 5 of the drainage core 4, which are described in FIG. 1. The bend on the drainage element can be formed so that only slight bending stresses occur and consequently the service life of the drainage core or of a coupling element can be distinctly increased over that of the known version.

A further advantage of the invention is that the components for the individual functions can be designed very compactly by means of the spatial separation of the filter fixing and the fastening of the free ends of the drainage element in the pressing plates. It follows that there are cost advantages, primarily with the elements for fastening the drainage element in the pressing plates and in the fixing points of the pressing plate in the fruit press.

One advantage achieved with the invention is also that a further expendable part of the known version is no longer necessary, namely the flexible sleeve 8. Consequently, damages to the filter can also be prevented, which arise due to torn sleeves.

BRIEF DESCRIPTION OF THE DRAWINGS

The invention is explained further in the following description and the drawings, in which.

DETAILED DESCRIPTION OF THE PREFERRED EMBODIMENTS

Figure 2:
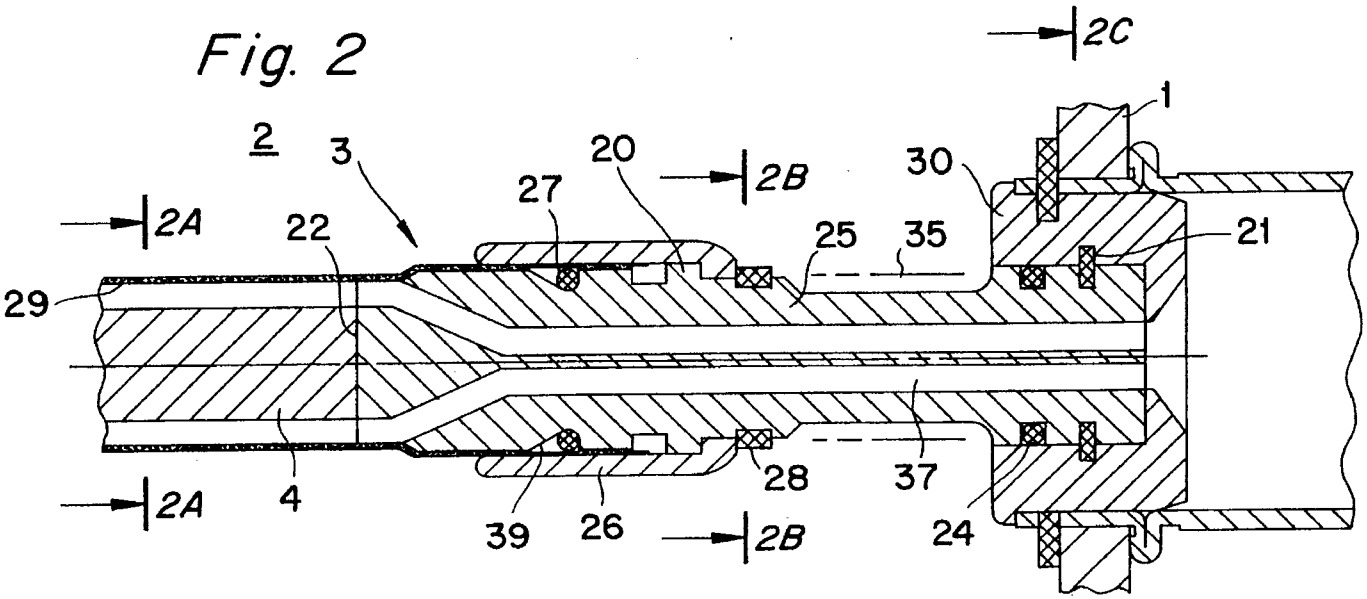
FIG. 2 shows a section through a fastening of a drainage element according to the invention to the pressing plate of a fruit press.
Figure 2C:
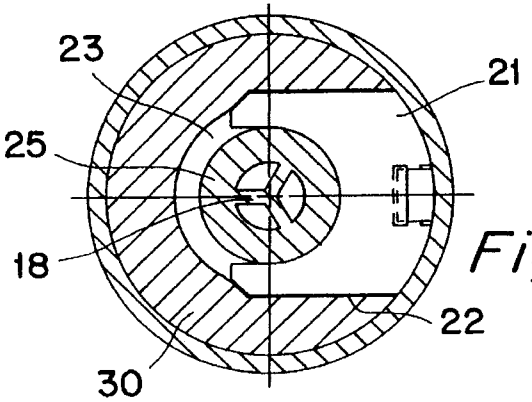
FIG. 2C is a cross section taken along the line 2C—2C in FIG. 2.
Figure 2B:
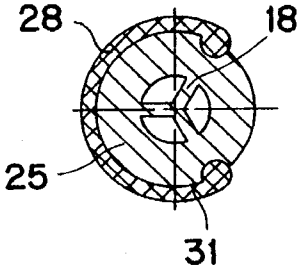
FIG. 2B is a cross section taken along the line 2B—2B in FIG. 2.
Figure 2A:
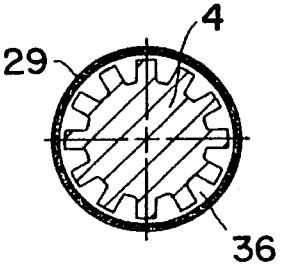
FIG. 2A is a cross section taken along the line 2A–2A in FIG. 2.

As can be seen from FIG. 2, a multitude of drainage elements 3 are disposed in a pressing chamber 2, which is defined by each pressing plate 1, of a fruit press, which is not shown. Each drain element 3 includes a flexible drainage core 4, on each of whose free ends 22 a flexible coupling piece 25 of similar material is welded, as well as a clamping sleeve 26, an O-ring 27, and a securing spring 28 for fixing a filter 29 on the coupling piece 25. The connection of the free end of the coupling piece 25 to the pressing plate 1 takes place via a coupling retainer 30. The securing against axial sliding from the free end of the coupling piece 25 in the coupling retainer 30 is achieved with a securing spring 21, which is thrust laterally into the coupling retainer 30 by means of a slit 22 (FIG. 2C) and engages in a groove 23 on the end of the coupling piece 25. An O-ring 24 is used to seal the joining face between the free end of the coupling piece 25 and the coupling retainer 30.

A sharp bending of the drainage element 3 during the pressing process takes place according to the invention in a flexible, filter-free part 35 of the coupling piece 25 between the securing spring 28, which is for fixing the filter, and the clamping position of the coupling piece 25 in the coupling retainer 30. The sock-shaped filter 29 is not stressed.

The fluid flowing from the pressing chamber 2 is conducted by external grooves 36 of the drainage core 4 into a central discharge conduit 37. In order to prevent a reduction of the discharge cross section when the drainage element 3 bends in the flexible part 35 of the coupling piece 25, the discharge conduit 37 is reinforced with three ribs 18. The reinforcing of the discharge conduit 37 can also alternatively take place via a separate spiral spring, not shown, which is inserted into the discharge conduit 37.

The fixing of the filter 29 on the coupling piece 25 is carried out with the help of the clamping sleeve 26 and the O-ring 27, which is disposed in a groove 39 on the coupling piece 25, which groove is sloped on one side. The clamping sleeve 26 is thrust toward the drainage core 4 over the filter 29 and is secured against axial sliding by a collar 20, which is disposed on the right end of the clamping sleeve 26, and by the securing spring 28, which can be laterally inserted into a groove 31 on the coupling piece 25. If a tensile load acts upon the filter 29 in the direction of the drainage core 4, then the O-ring 27, due to frictional forces, works its way up onto the sloped groove 39, and thus the tension force acting upon the filter increases between clamping sleeve 26 and the O-ring 27.

Figure 3:
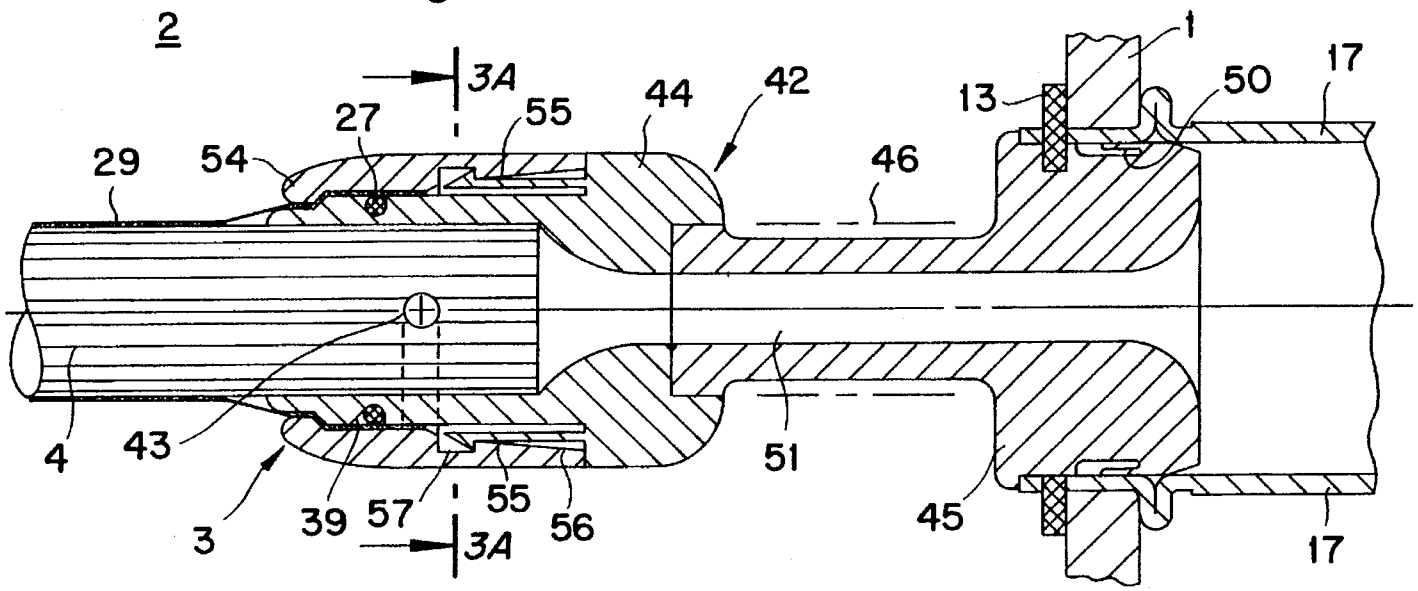
FIG. 3 shows a section through a fastening of another drainage element according to the invention to the pressing plate of a fruit press.
Figure 3A:
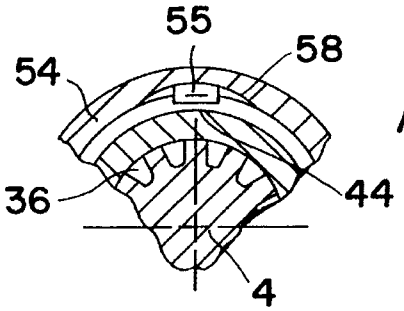
FIG. 3A is a cross section taken along the line 3A—3A in FIG. 3.

In the exemplary embodiment shown in FIG. 3, components already explained in FIG. 2 have the same reference numerals, which were indicated there. Here, a drainage core 4 is detachably connected to a coupling part 42 by means of a lateral pin 43. The coupling part 42 comprises a core retainer 44, for example of plastic, and a one-piece coupling retainer 45 with a flexible bending region 46, which are firmly connected to each other by welds or adhesive. The connection from the free end of the coupling retainer 45 to a pressing plate 1 takes place with the help of a distance bush 17 and a snap ring 13, as already described in FIG. 1. The sealing of the joining face between the free end of the coupling retainer 45 and the distance bush 17 can take place by means of a sealing lip 50 disposed on the coupling retainer 45.

The fixing of a filter 29 on the core retainer 44 takes place with the help of a clamping sleeve 54 and an O-ring 27, which is disposed in a groove 39 of the core retainer 44, which groove is sloped on one side. Upon assembly, the clamping sleeve 54 is slipped on in the direction of the pressing plate 1, over the filter 29 and the O-ring 27 disposed under it. The fixing of the clamping sleeve 54 on the core retainer 44 takes place via a snap fastener. When the clamping sleeve 54 reaches its end position, two spring hooks 55, which are disposed on the core retainer 44 and which upon assembly are tensed in a sloped groove 56 in the clamping sleeve 54, snap into recesses 57 of the clamping sleeve 54, which are provided for this purpose. Alternatively, the fixing of the clamping sleeve 54 on the core retainer 44 can also be produced by a bayonet mount, not shown, or a threaded joint. To embody the snap connection, the clamping sleeve 54 is rotated with respect to the core retainer 44; the spring hooks 55 are pressed outward out of the recesses 57 via inclines 58. Then the clamping sleeve 54 can be pulled off of the core retainer 44.

The fluid flowing out of a pressing chamber 2 is conducted into the core retainer 44 via the grooves 36 of the drainage core 4 and arrives outside the pressing chamber 2 by means of a central discharge conduit 51 of the coupling retainer 45.

Figure 4:
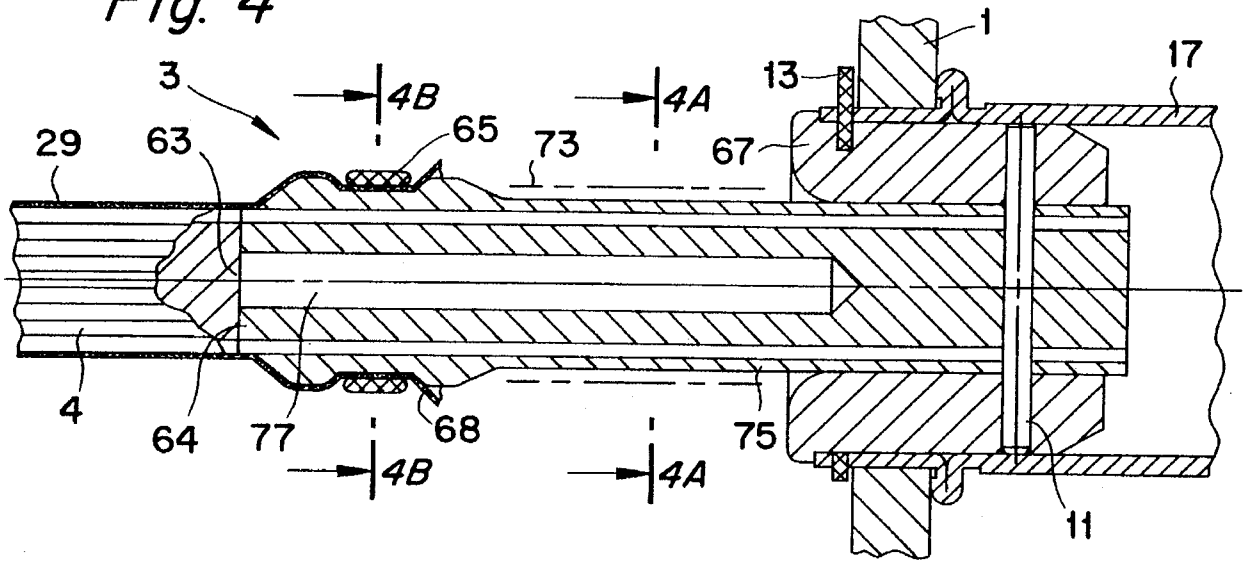
FIG. 4 shows a section through a fastening of a further drainage element according to the invention to the pressing plate of a fruit press.
Figure 4B:
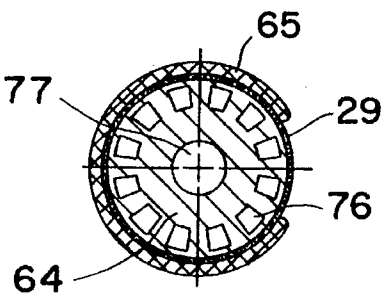
FIG. 4B is a cross section taken along the line 4B—4B in FIG. 4.
Figure 4A:
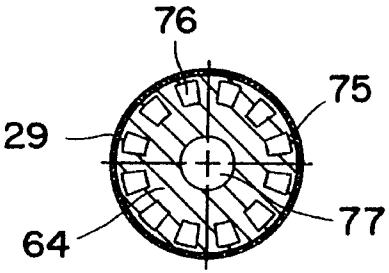
FIG. 4A is a cross section taken along the line 4A—4A in FIG. 4.

The drainage element 3 shown in FIG. 4 comprises a drainage core 4, onto each of whose free ends 22 is welded a coupling piece 64 of similar material, a fixing of the filter 29, and a coupling retainer 67. The fixing of the filter 29 in the recess 68 provided for this purpose on the coupling piece 64 takes place with two or more C-shaped tension springs 65, as shown by section 4B—4B. The tension springs 65 are installed with openings, which are offset on the circumference, above the filter 29 in the region of the recess 68. The coupling piece 64 is fixed in the coupling retainer 67 with a lateral pin 11.

Figure 1:
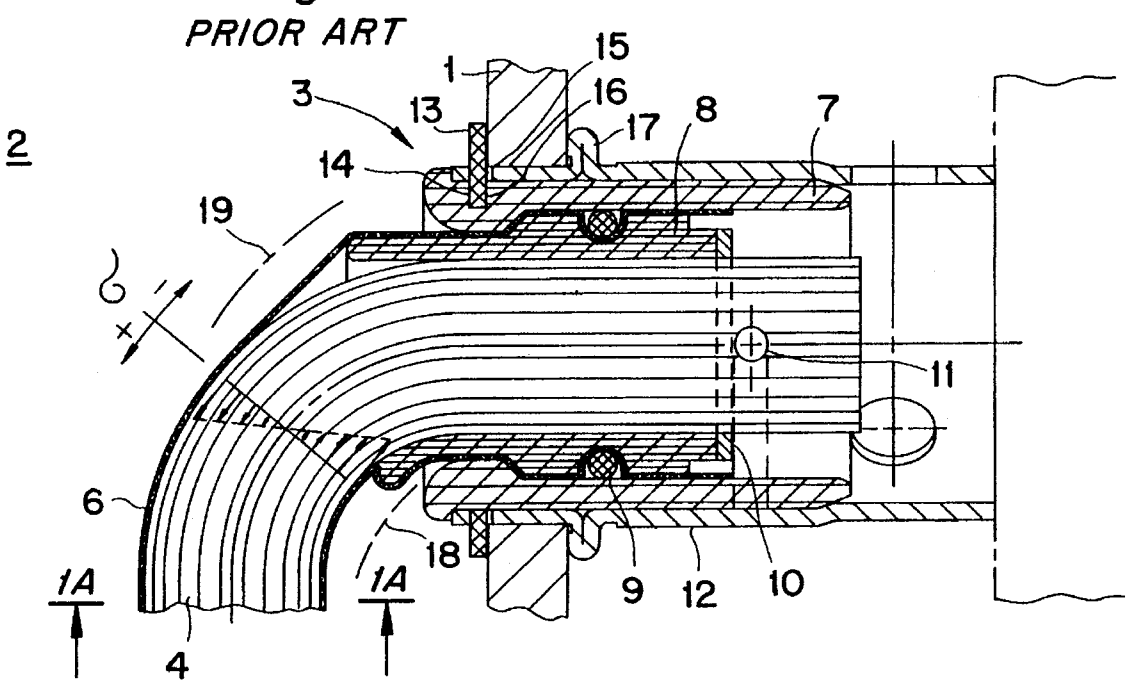
Fig. 1 PRIOR ART
FIG. 1 shows a section through a known fastening of a drainage element to the pressing plate of a fruit press.
Figure 1A:
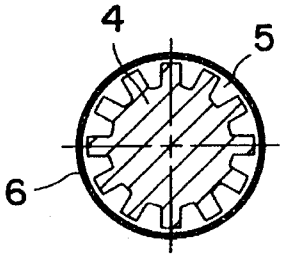
Fig. 1A PRIOR ART
FIG. 1A is a cross section taken along the line 1A—1A in FIG. 1.

The fastening of the drainage element 3 in a pressing plate 1 takes place via the coupling retainer 67 with a distance bush 17 and a snap ring 13 as already described under FIG. 1.

In contrast to the exemplary embodiments shown in FIGS. 2 and 3, in the bending region 73 of the drainage element 3, the fluid to be conducted out of a pressing chamber 2 is conveyed not by means of a central discharge conduit, but by means of grooves 76 of the coupling piece 64, which grooves are sheathed with a covering layer 75. In order to encourage the bending of the drainage element 3 in the bending region 73, a bore 77 is placed in the coupling piece 64.

Figure 5:
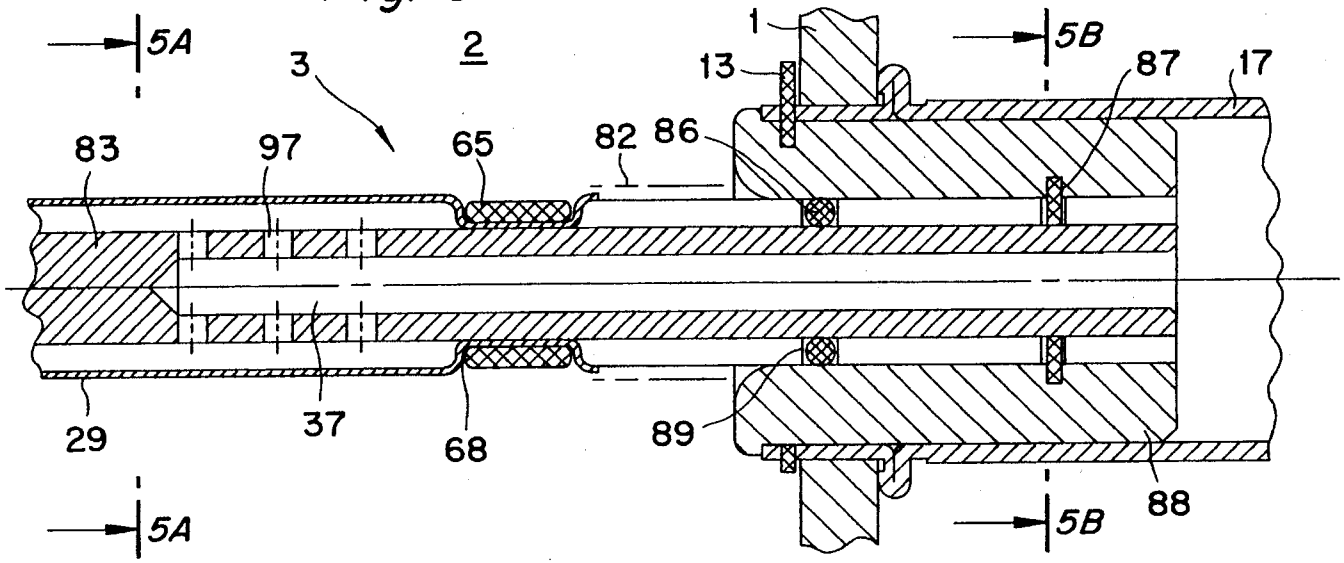
FIG. 5 shows a section through a fastening of a further drainage element according to the invention to the pressing plate of a fruit press.
Figure 5B:
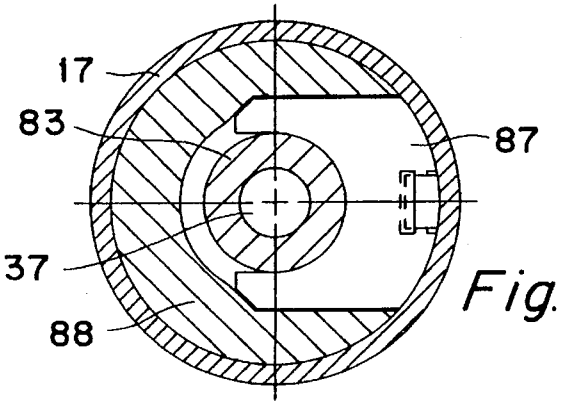
FIG. 5B is a cross section taken along the line 5B—5B in FIG. 5.
Figure 5A:
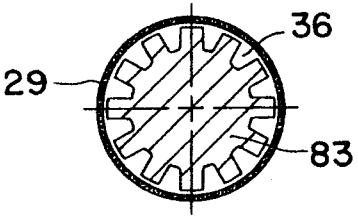
FIG. 5A is a cross section taken along the line 5A—5A in FIG. 5.

In contrast to the exemplary embodiments described under FIGS. 2–4, in a drainage element 3 shown in FIG. 5, no separate coupling piece is used in a bending region 82, but the required part functions are achieved with the help of a modified drainage core 83.

The drainage element 3 comprises the drainage core 83, the sock-like filter 29, a filter fixing 65, not shown further, on the drainage core 83, an O-ring 86, and a securing disk 87 for axially fastening the drainage core 83 in a core retainer 88. The axial fastening of the drainage core 83 in the core retainer 88 is achieved with the same means, which are explained in detail under FIG. 2. The O-ring 86, which is disposed in a groove 89 in the drainage core 83, serves to seal the joining face. The fixing 65 of the filter 29 in a recess 68, which is provided for this purpose on the drainage core 83, can take place by means of firmly connecting the filter 29 with a string, a flexible tape having a velcro fastener, or the like.

The fastening of the drainage element 83 in a pressing plate 1 takes place via the core retainer 88 with a distance bush 17 and a snap ring 13, as already described under FIG. 1.

The fluid to be conducted out of a pressing chamber 2 is conveyed by means of the grooves 36 of the drainage core 83 and, in the bending region 82 of the drainage element 3, by a central bore 37 in the drainage core 83. The transfer of the fluid into the central bore 37 occurs before the filter fixing 65 by means of a plurality of radially disposed bores 97.

What is claimed is:

1. Drainage apparatus through which fluids are removed from a compression chamber through a boundary member as liquid is expressed from a solid in said compression chamber, said drainage apparatus including a rod-shaped flexible drainage core fixed at a first location to said boundary member and being provided with liquid flow paths to conduct the pressed-out fluid from the compression chamber, and a fluid-permeable filter envelope surrounding said drainage core, at least one end of said drainage core being fastened to said boundary member at a first location and said fluid-permeable filter envelope being fastened to said drainage core at a second location spaced apart from said first location, and said drainage core including a connecting portion fastened to said filter envelope and to said compression chamber boundary member, said connection portion having at least one internal liquid discharge conduit, and the rigidity of said connecting portion being such that flexing of the drainage core occurs only in the region of the connecting portion between the location where said core is between fastened to said boundary member and the location where said core is fastened to said filter envelope.

2. Drainage apparatus according to claim 1, wherein the location at which said filter envelope is fixed to said drainage core is spaced toward the interior of said compression chamber from the location where said drainage core is fixed to said boundary member.

3. Drainage apparatus according to claim 1, wherein said internal liquid discharge conduit in said connecting portion is connected to said liquid flow paths in said drainage core by passages in said connecting portion.

4. Drainage apparatus according to claim 1, wherein said connecting portion includes a first part which said filter envelope is fastened, a second part to which said boundary member is fastened, and a spacer disposed between these parts and being connected to the drainage core via a detachable connection.

5. Drainage apparatus according to claim 1, wherein said connecting portion, includes a first part to which said filter envelope is fastened, a second part to which said boundary member is fastened, and a spacer disposed between said first and second parts and being welded to the drainage core.

6. Drainage apparatus according to claim 1, wherein said connecting portion of the drainage core, includes a first part to which said filter envelope is fastened, a second part to which said boundary member is fastened, and a spacer disposed between said first and second parts and being manufactured of one piece with the drainage core.

7. Drainage apparatus according to claim 1, wherein said connecting portion of the drainage core includes a first pan to which said filter envelope is fastened, a second part to which said boundary member is fastened, and a spacer disposed between said first and second parts and having a central axial bore which is closed toward the outside and is disposed in the region of the bending zone.

8. Drainage apparatus according to claim 1, wherein said connecting portion of the drainage core includes a first part to which said filter envelope is fastened, a second part to which said boundary member is fastened, and a spacer disposed between said first and second pans and having therein at least one groove engaged by a securing spring in the form of a lateral slide.

9. Drainage apparatus according to claim 1, wherein said connecting portion of the drainage core includes a coupling retainer formed of elastic material.

10. Drainage apparatus according to claim 1, wherein an O-ring and a clamping sleeve are provided to fasten said filter envelope to said connecting portion of the drainage core.

11. Drainage apparatus according to claim 1, wherein a clamping sleeve is connected to said connecting piece of said drainage core via a detachable snap fastener.

12. Drainage apparatus according to claim 1, wherein said filter envelope is firmly secured on said connecting portion of the drainage core directly with at least one C-shaped tension spring.

13. Drainage apparatus according to claim 1, wherein said filter envelope is fastened to said connecting portion of said drainage core by flexible band means.

14. Drainage apparatus according to claim 1, wherein said connecting portion of the drainage core includes a first part to which said filter envelope is fastened, a second part to which said boundary member is fastened, and a spacer disposed between said first and second parts, and wherein the outer diameter of said spacer is no greater than the expanded inner diameter of said filter envelope.

* * * * *